US007895921B2

(12) United States Patent
Huang

(10) Patent No.: US 7,895,921 B2
(45) Date of Patent: Mar. 1, 2011

(54) RATCHET TOOL

(76) Inventor: Ping Wen Huang, Wurih Township, Taichung County (TW)

( * ) Notice: Subject to any disclaimer, the term of this patent is extended or adjusted under 35 U.S.C. 154(b) by 0 days.

(21) Appl. No.: 12/149,590

(22) Filed: May 5, 2008

(65) Prior Publication Data

US 2010/0288082 A1 Nov. 18, 2010

(51) Int. Cl.
*B25B 13/46* (2006.01)

(52) U.S. Cl. ..... 81/63.1

(58) Field of Classification Search ..... 81/60–63.2; 192/43.1, 43.2
See application file for complete search history.

(56) References Cited

U.S. PATENT DOCUMENTS 2,193,984 A * 3/1940 Rhinevault ..... 81/63.1
2,201,827 A * 5/1940 Froeschl et al. ..... 81/63.1
6,044,731 A * 4/2000 Hsieh ..... 81/63.2
6,279,428 B1 * 8/2001 Huang ..... 81/63.1
6,408,722 B1 * 6/2002 Chen ..... 81/60
7,313,987 B1 * 1/2008 Chen et al. ..... 81/63.1

* cited by examiner

*Primary Examiner*—Hadi Shakeri
(74) *Attorney, Agent, or Firm*—Wang Law Firm; Li K. Wang

(57) ABSTRACT

A ratchet tool includes a head and a handle, a ratchet is received in the space and two pawl sets are respectively received in two recesses defined in the inner periphery of the space. Each pawl set has a pawl and a spring which biases the pawl to be engaged with the teeth of the ratchet. Each pawl has a flat surface defined in the end having the engaging teeth. An operation member has a flange which is rotatably engaged with a groove defined in the inner periphery of the space and the flange includes a pressing surface which presses one of the flat surfaces of the two pawls by operating the operation member. By choosing one of the pawls to be engaged with the ratchet, the ratchet tool can output torque in desired direction.

6 Claims, 7 Drawing Sheets

RATCHET TOOL

FIELD OF THE INVENTION

The present invention relates to a hand tool and more particularly, to a ratchet tool.

BACKGROUND OF THE INVENTION

A conventional ratchet tool is shown in FIG. 7, and generally includes a handle 90 with a head 91 connected to an end thereof and a space 92 is defined in the head 91 so as to receive a ratchet 93 therein. A hole 94 is defined through a wall of the head 91 and communicates with the space 92, a pawl 95, a spring 96 and a seal member 97 are engaged with the hole 94. The pawl 95 is biased by the spring 96 so as to be engage with the ratchet 93 which can be operated in one direction.

It is noted that the hole 94 is defined through the wall of the head 91 and this weakens the structural strength of the head 91 which may not be able to bear large torque during use.

The ratchet 93 is engaged with the pawl 95 and can only work in one direction and this cannot meet requirements of use for ratchet tools.

The present invention intends to provide a ratchet tool that includes a compact and simple structure and can be operated in two different directions.

SUMMARY OF THE INVENTION

The present invention relates to a ratchet tool that comprises a head and a handle, wherein the head has a space defined therein and a first groove is defined in an inner periphery of the space. A ratchet is received in the space and has teeth defined in an outer periphery thereof. The ratchet has an engaging portion so as to be engage with a work piece. Two recesses are defined in the inner periphery of the space so as to respectively receive two pawl sets therein.

Each pawl set has a pawl and a spring which is located on an inner end of the recess and biases the pawl to protrude out from the recess corresponding thereto. Each pawl has engaging teeth defined in an end thereof which protrudes into the space and are removably engaged with the teeth of the ratchet. Each pawl has a flat surface defined in the end having the engaging teeth.

An operation member has a flange rotatably engaged with the first groove and the flange includes a pressing surface which presses one of the flat surfaces of the two pawls.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
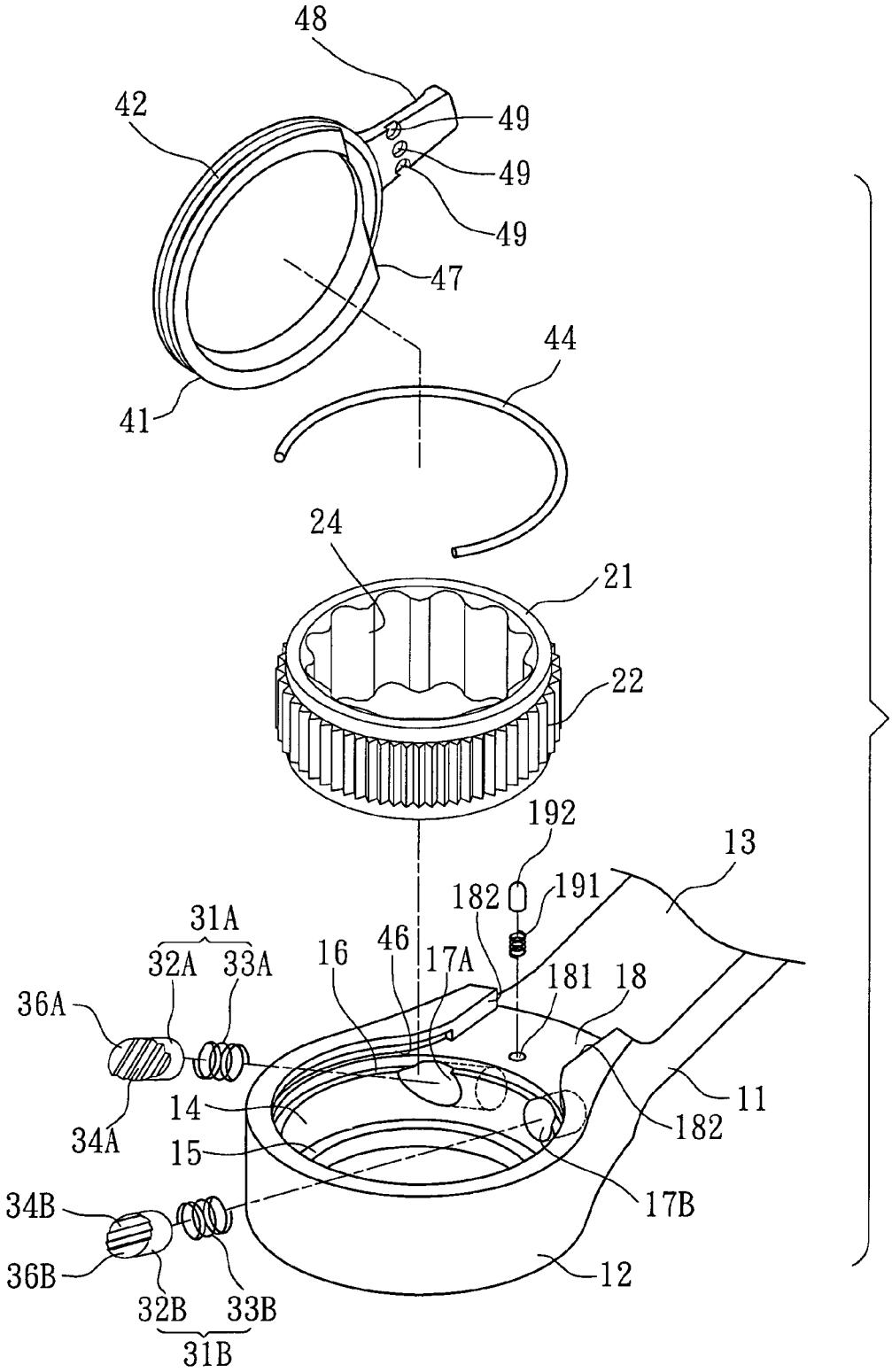
FIG. 1 is an exploded view to show the ratchet tool of the present invention.

Referring to FIG. 1, the ratchet tool 1 of the present invention comprises a head 12 and a handle 13 is connected to the head 12, the head 12 includes a space 14 defined therein and a ratchet 21 is rotatably received in the space 14. The ratchet 21 has teeth 22 defined in an outer periphery thereof and an engaging portion which is used to engage with a work piece such as a nut or a bolt head (not shown). In FIG. 1, the engaging portion is a hole defined through the ratchet 21 and includes a polygonal inner periphery 24. A lip 15 extends inward from the inner periphery of the space 14 and a first side of the ratchet 21 is stopped by the lip 15. First and second recesses 17A, 17B are defined in the inner periphery of the space 14.

A first pawl set 31A and a second pawl set 31B are respectively received in the first and second recesses 17A, 17B and each of the first and second pawl sets 31A, 31B has a pawl 32A/32B and a spring 33A/33B which is located on an inner end of the first/second recess 17A/17B and biases the first/second pawl 32A/32B to protrude out from the first/second recess 17A/17B corresponding thereto. Each first/second pawl 32A/32B has engaging teeth 34A/34B defined in an end thereof which protrudes into the space 14 and is located corresponding the teeth 22 of the ratchet 21. The engaging teeth 34A/B of each first/second pawl 32A/32B are removably engaged with the teeth 22 of the ratchet 21. Each first/second pawl 32A/32B has a first/second flat surface 36A/36B defined in the end having the engaging teeth 34A/34B. The first and second pawls 32 are shaped to fit in the first and second recesses 17A, 17B so that the first and second pawls 32 are movable axially and linearly in the first and second recesses 17A, 17B.

An operation member 41 has a flange rotatably engaged with a first groove 16 defined in the inner periphery of the space 14 and the flange includes a pressing surface 47 which presses one of the first/second flat surfaces 36A/36B of the first and second pawls 32A, 32B. A second side of the ratchet 21 is engaged with the operation member 41. The operation member 41 includes a second groove 42 defined in an outer periphery thereof and a clip 44 is engaged with the second groove 42. The clip 44 is engaged with a positioning groove 46 defined in the inner periphery of the space 14 so as to position the operation member 41.

A recessed area 18 is defined in a side of the head 12 and a hole 181 is defined in the recessed area 18. A spring 191 and a block 192 are engaged with the hole 181. The operation member 41 includes a lever 48 and a plurality of notches 49 are defined in an underside thereof. The lever 48 are movably received in the recessed area 18 and the block 192 is engaged with one of the notches 49. The recessed area 18 includes two sidewalls 182 and two sides of the lever 48 are stopped by the two sidewalls 182 when operating the lever 48 to choose desired direction to output torque.

Figure 2:
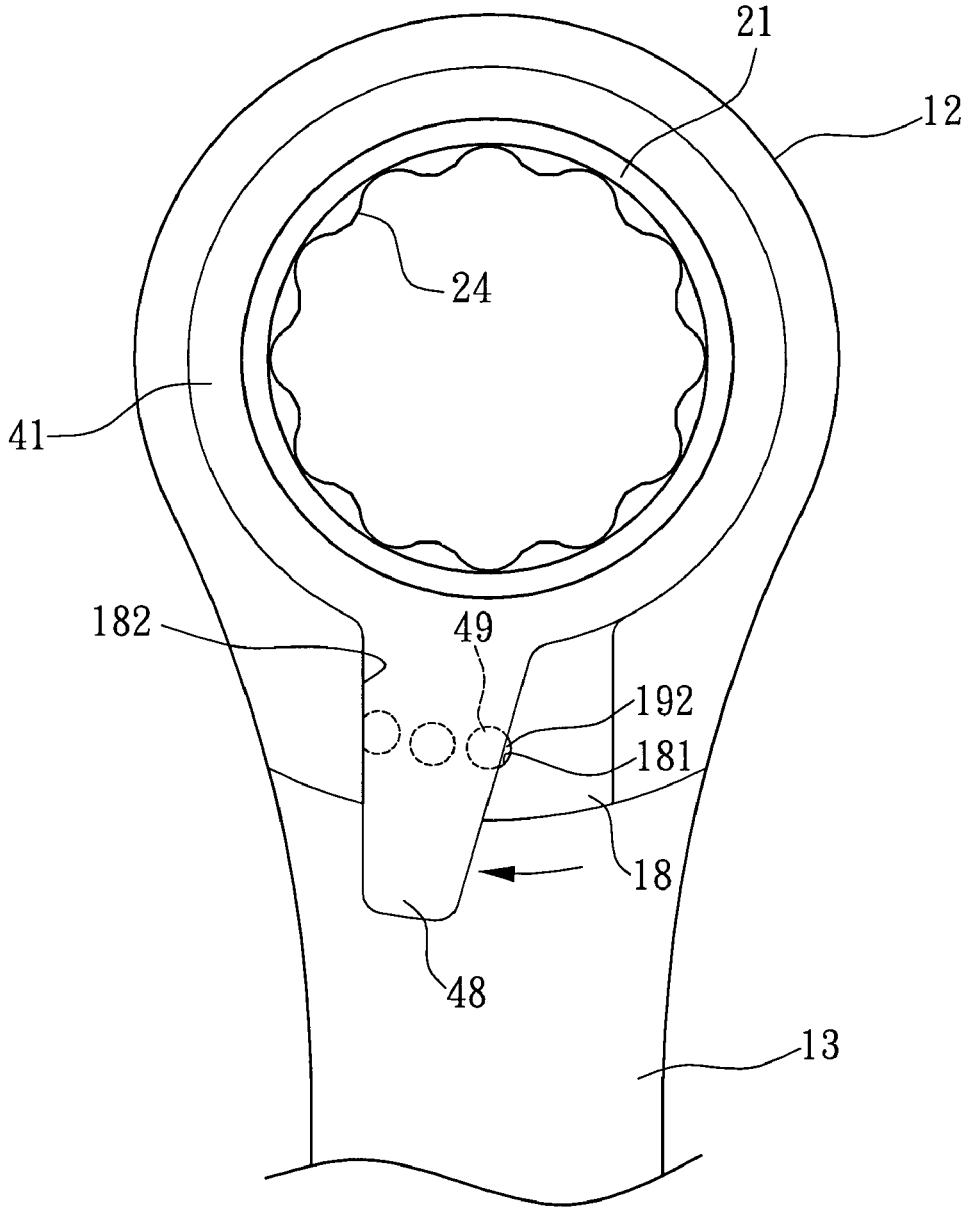
FIG. 2 shows that the lever of the operation member is shifted to left and the block is engaged with one of the notches.
Figure 3:
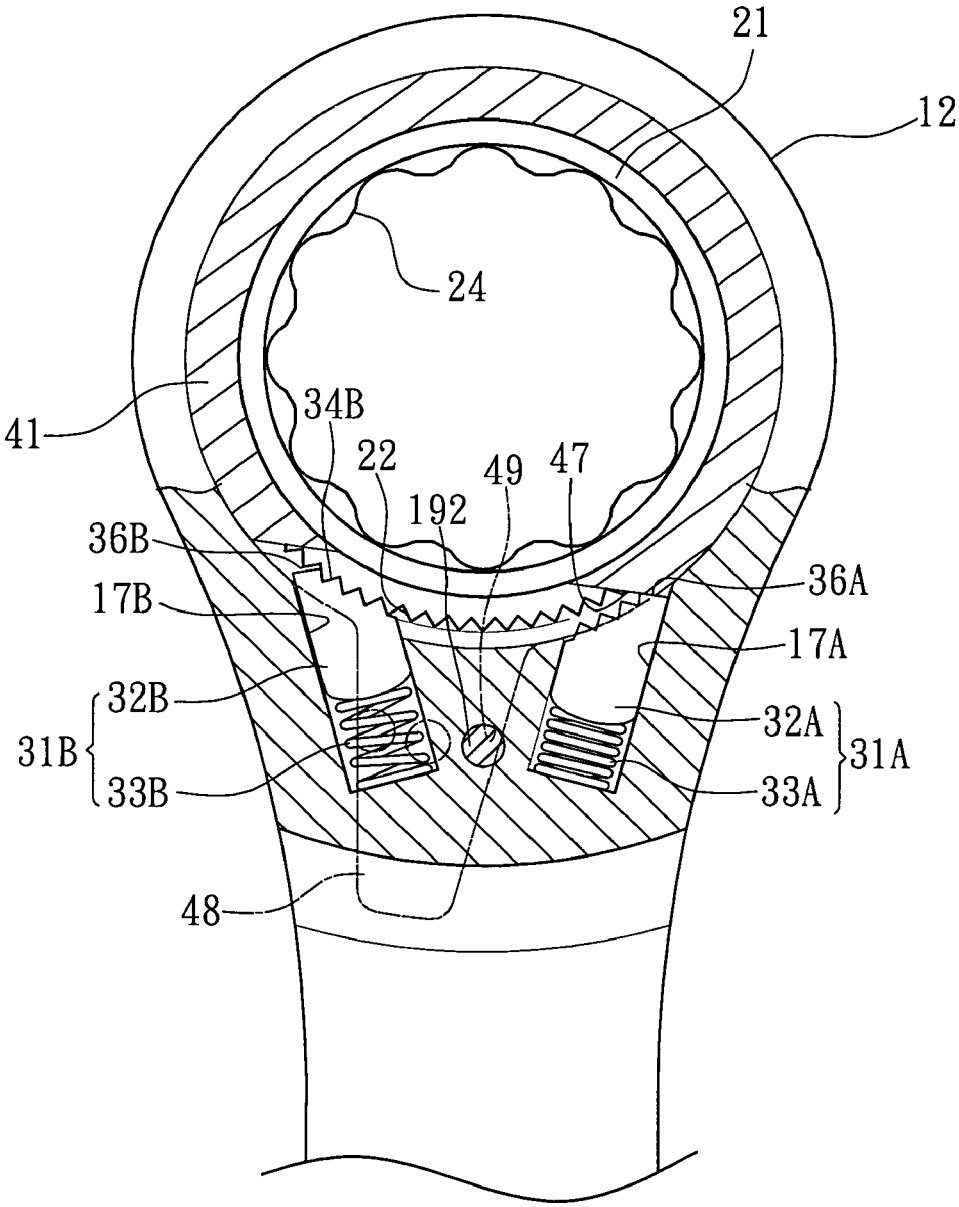
FIG. 3 is a partial cross sectional view to show the first pawl is engaged with the ratchet and the second pawl is separated from the ratchet when shifting the lever to left.

As shown in FIGS. 2 and 3, when shifting the lever 48 to the left and the left side of the lever 48 is stopped by the left sidewall 182. The pressing surface 47 of the operation member 41 is rotated when shifting the lever 48 and presses the first flat surface 36A so that the first pawl 32A is pushed to disengage from the teeth 22 of the ratchet 21. The second pawl 32B is not pressed by the pressing surface 47 and pushed by the second spring 33B, so that the engaging teeth 34B are engaged with the teeth 22 of the ratchet 21. The block 192 is engaged with the right end notch 19. In this status, when rotating the ratchet tool clockwise, the work piece 9 (not shown) engaged with the polygonal inner periphery 24 and the head 12 are co-rotated clockwise. When rotating the handle 13 counter clock-wise, the second pawl 32B is pushed by the teeth 22 of the ratchet 21 and compresses the second spring 33B, so that the work piece is remained still and the handle 13 is rotated an angle.

Figure 4:
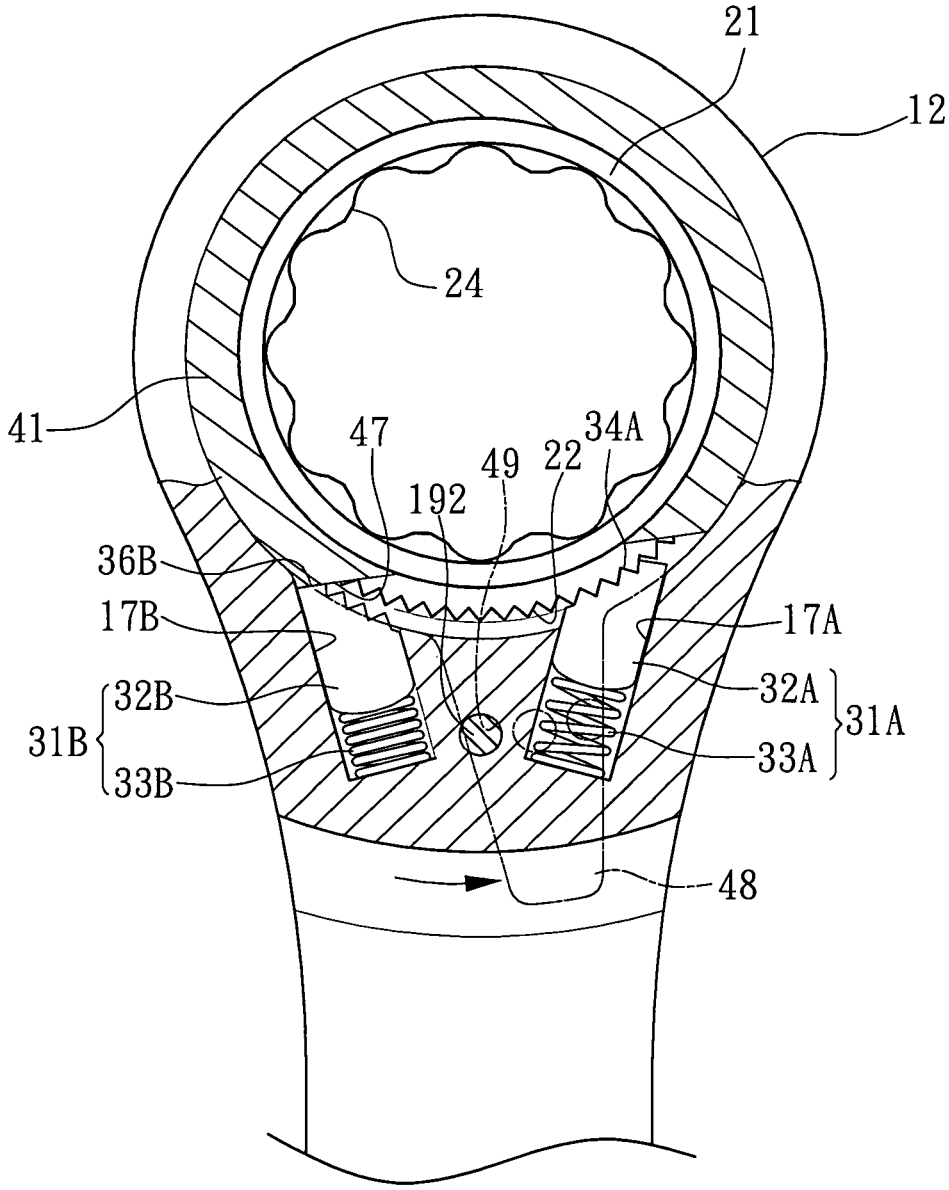
FIG. 4 is a partial cross sectional view to show the second pawl is engaged with the ratchet and the first pawl is separated from the ratchet when shifting the lever to right.

As shown in FIG. 4, when shifting the lever 48 to the right and the right side of the lever 48 is stopped by the right sidewall 182. The pressing surface 47 of the operation member 41 is rotated when shifting the lever 48 and presses the second flat surface 36B so that the second pawl 32B is pushed to disengage from the teeth 22 of the ratchet 21. The first pawl 32A is not pressed by the pressing surface 47 and pushed by the first spring 33A, so that the engaging teeth 34A are engaged with the teeth 22 of the ratchet 21. The block 192 is engaged with the left end notch 19. In this status, when rotating the ratchet too 1 counter clockwise, the work piece 9 (not shown) engaged with the polygonal inner periphery 24 and the head 12 are co-rotated counter clockwise. When rotating the handle 13 clock-wise, the first pawl 32A is pushed by the teeth 22 of the ratchet 21 and compresses the first spring 33A, so that the work piece is remained still and the handle 13 is rotated an angle.

Figure 5:
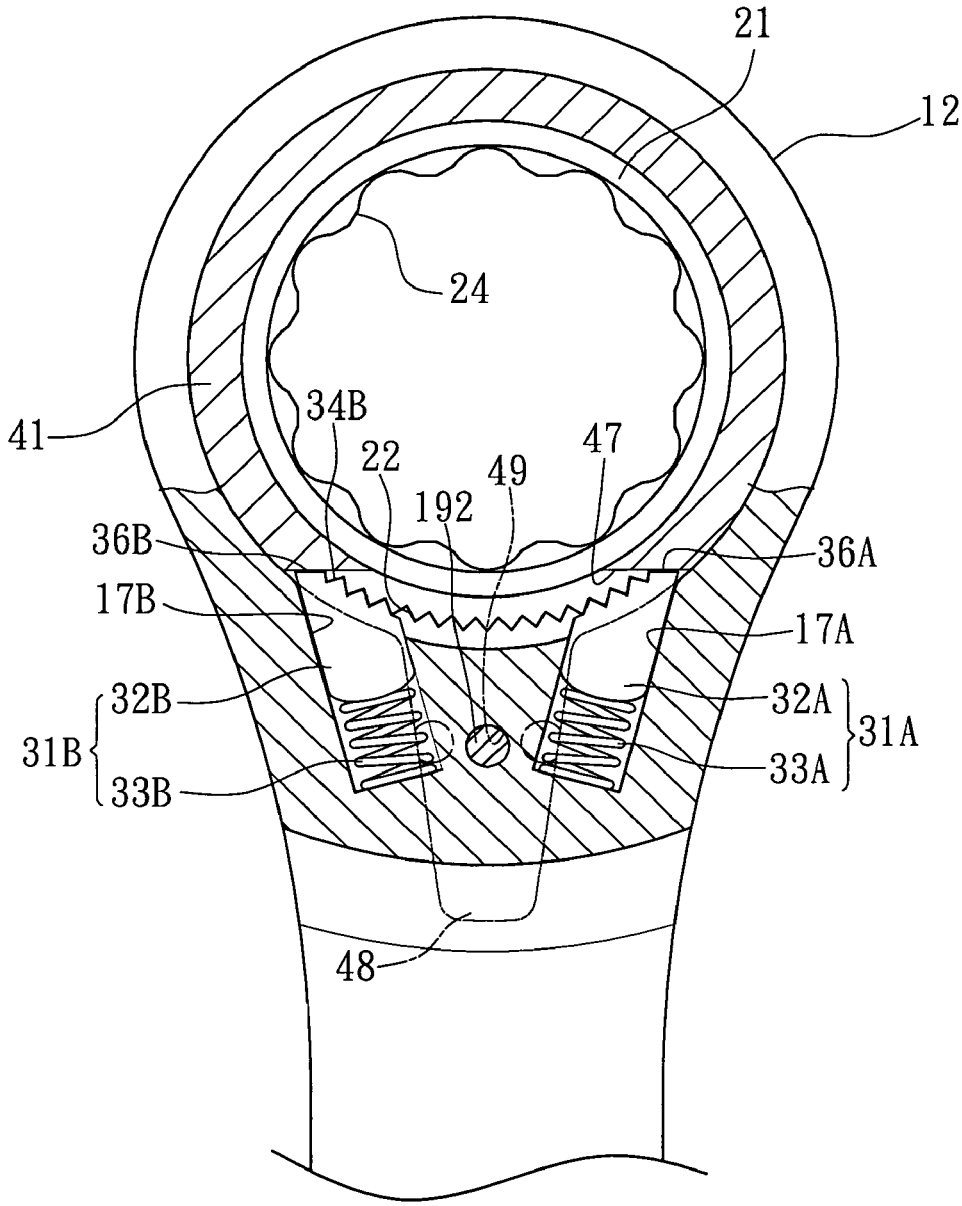
FIG. 5 is a partial cross sectional view to show that both of the first and second pawls are separated from the ratchet when shifting the lever to the center.

As shown in FIG. 5, when the lever 48 is positioned at the center of the recessed area 18, the block 192 is engaged with the notch 49 at the middle position. The first and second pawls 32A, 32B are not compressed by the pressing surface 47, and the first and second pawls 32A, 32B are biased by the first and second springs 33A, 33B to engage with the teeth 22 of the ratchet 21, so that the ratchet 21 cannot rotate in either direction.

Figure 6:
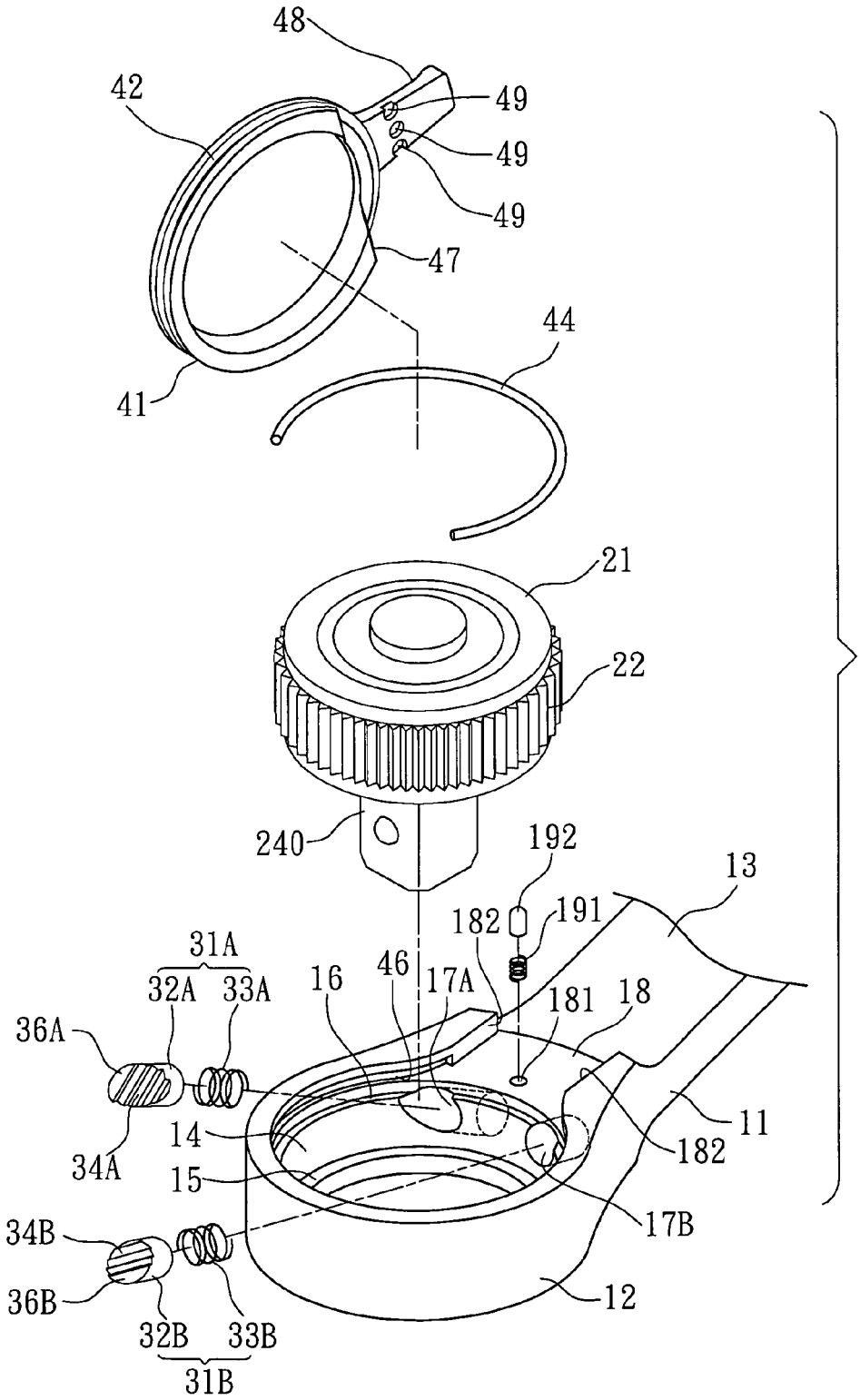
FIG. 6 is an exploded view to show another embodiment of the ratchet tool of the present invention.
Figure 7:
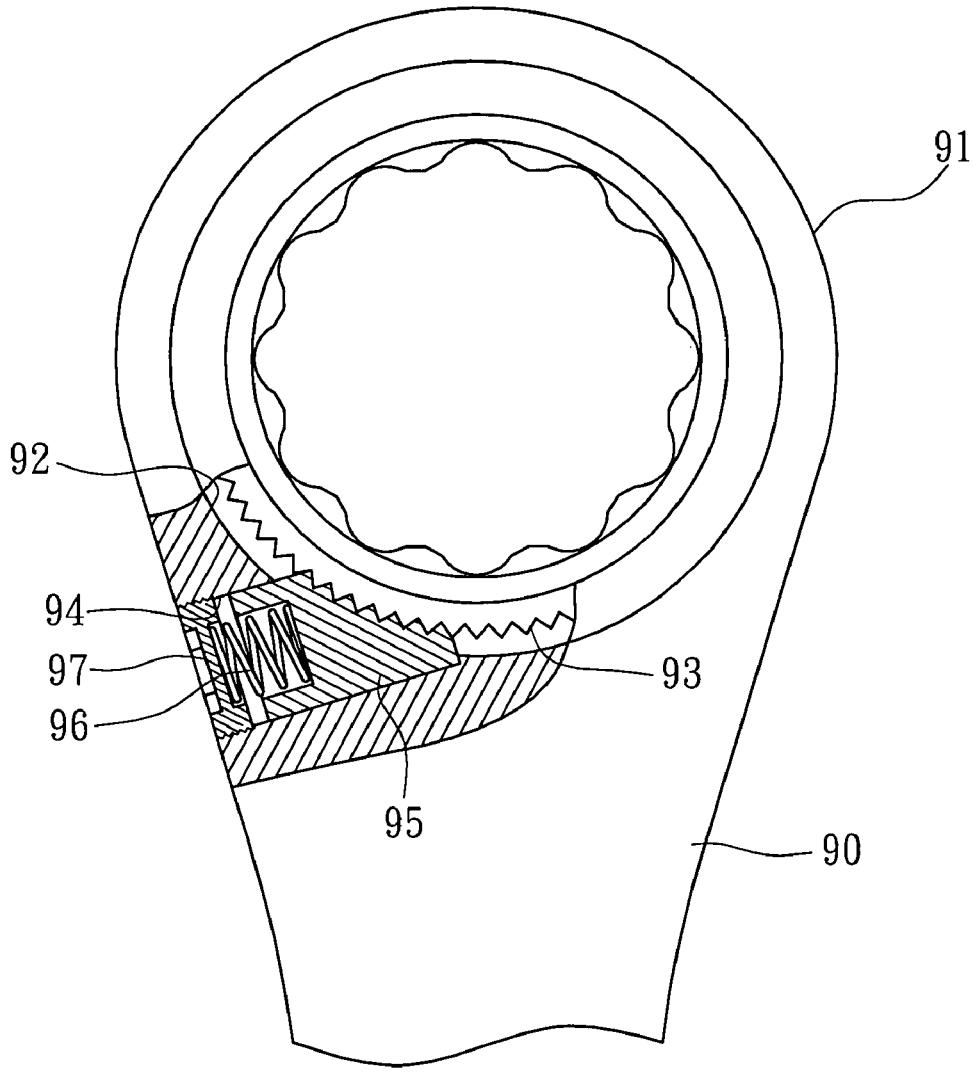
FIG. 7 PRIOR ART
FIG. 7 is a partial cross sectional view to show a conventional ratchet tool.

FIG. 6 shows that the engaging portion of the ratchet 21 can be a driving protrusion 240 extending from a side of the ratchet 21 so as to be connected with a sleeve (not shown).

While we have shown and described the embodiment in accordance with the present invention, it should be clear to those skilled in the art that further embodiments may be made without departing from the scope of the present invention.

What is claimed is:

1. A ratchet tool comprising:

a head and a handle connected to the head, the head having a space defined therein and a first groove defined in an inner periphery of the space, a ratchet received in the space and having teeth defined in an outer periphery thereof, the ratchet having an engaging portion, two recesses defined in the inner periphery of the space;

two pawl sets respectively received in the two recesses and each pawl set having a pawl and a spring which is located on an inner end of the recess and biases the pawl to protrude out from the recess corresponding thereto, each pawl having engaging teeth defined in an end thereof which protrudes into the space and is located corresponding the teeth of the ratchet, the engaging teeth of each pawl removably engaged with the teeth of the ratchet, each pawl having a flat surface defined in the end having the engaging teeth; and an operation member having a flange rotatably engaged with the first groove and the flange including a pressing surface which presses one of the flat surfaces of the two pawls, wherein a recessed area is defined in a side of the head and a hole is defined in the recessed area, a spring and a block are engaged with the hole, the operation member includes a lever and a plurality of notches are defined in an underside thereof, the block-is engaged with one of the notches, wherein the recessed area includes two sidewalls and two sides of the lever are stopped by the two sidewalls.

2. The ratchet tool as claimed in claim 1, wherein a lip extends inward from the inner periphery of the space and a first side of the ratchet is stopped by the lip, a second side of the ratchet is engaged with the operation member.

3. The ratchet tool as claimed in claim 1, wherein the operation member includes a second groove defined in an outer periphery thereof and a clip is engaged with the second groove, the clip is engaged with a positioning groove defined in the inner periphery of the space so as to position the operation member.

4. The ratchet tool as claimed in claim 1, wherein the pawls are shaped to fit in the recesses so that the pawls are movable axially and linearly in the recesses.

5. The ratchet tool as claimed in claim 1, wherein the engaging portion of the ratchet includes a polygonal inner periphery.

6. The ratchet tool as claimed in claim 1, wherein the engaging portion of the ratchet includes a driving protrusion extending from a side of the ratchet.

* * * * *